US008176638B2

(12) United States Patent
Hann et al.

(10) Patent No.: US 8,176,638 B2
(45) Date of Patent: May 15, 2012

(54) ERGONOMIC SCISSORS

(76) Inventors: Abbe J. Hann, Stirling, NJ (US); Ronald B. Hann, Stirling, NJ (US)

( * ) Notice: Subject to any disclaimer, the term of this patent is extended or adjusted under 35 U.S.C. 154(b) by 350 days.

(21) Appl. No.: 12/458,747

(22) Filed: Jul. 22, 2009

(65) Prior Publication Data

US 2011/0016728 A1 Jan. 27, 2011

(51) Int. Cl.

| | |
|---|---|
| ***B26B 13/00*** | (2006.01) |
| ***B26B 19/00*** | (2006.01) |
| ***B25G 1/00*** | (2006.01) |
| ***B25G 1/12*** | (2006.01) |

(52) U.S. Cl. ..... 30/232; 30/194; 30/254; 30/341

(58) Field of Classification Search ..... 30/194, 30/195, 232, 255, 341, 271, 254; 403/362; 411/315

See application file for complete search history.

(56) References Cited

U.S. PATENT DOCUMENTS

| | | | | | |
|---|---|---|---|---|---|
| 590,330 | A | | 9/1897 | Nolen | |
| 753,919 | A | * | 3/1904 | Rowe | 30/256 |
| 1,479,908 | A | * | 1/1924 | Goshia | 30/341 |
| 2,158,277 | A | * | 5/1939 | Dolph | 30/341 |
| 2,571,675 | A | * | 10/1951 | Bray | 30/341 |
| 2,744,324 | A | * | 5/1956 | Chuba | 30/271 |
| 3,825,020 | A | * | 7/1974 | Myers | 132/200 |
| 4,146,961 | A | | 4/1979 | Pinto | |
| 4,642,895 | A | * | 2/1987 | Gauvry | 30/341 |
| 5,060,381 | A | * | 10/1991 | Taberlet | 30/232 |
| 5,109,608 | A | * | 5/1992 | Pracht | 30/341 |
| 5,125,159 | A | * | 6/1992 | Brenton et al. | 30/232 |
| 5,469,624 | A | * | 11/1995 | Brenton et al. | 30/232 |
| 5,517,762 | A | * | 5/1996 | Kuribayashi | 30/260 |
| 5,722,171 | A | * | 3/1998 | Schmidt | 30/255 |
| 5,987,757 | A | * | 11/1999 | Schmidt et al. | 30/341 |
| 6,212,780 | B1 | * | 4/2001 | Huang | 30/232 |
| 6,249,977 | B1 | * | 6/2001 | Knoop | 30/232 |
| 6,367,155 | B2 | * | 4/2002 | Homann | 30/140 |
| 6,915,578 | B2 | * | 7/2005 | Yusufov et al. | 30/232 |
| 7,260,894 | B2 | * | 8/2007 | Zammitto | 30/232 |
| 7,373,728 | B2 | | 5/2008 | Ferman et al. | |
| 7,464,474 | B2 | * | 12/2008 | Ishida | 30/232 |
| 7,966,733 | B2 | * | 6/2011 | Jun | 30/232 |
| 2005/0204569 | A1 | | 9/2005 | Brenton | |
| 2006/0064879 | A1 | * | 3/2006 | Lauritzen et al. | 30/232 |
| 2006/0143930 | A1 | * | 7/2006 | Adachi | 30/232 |

* cited by examiner

*Primary Examiner* — Ghassem Alie
*Assistant Examiner* — Bharat C Patel
(74) *Attorney, Agent, or Firm* — Thomas J. Germinario

(57) ABSTRACT

Ergonomic scissors are adjustable with respect to thumb offset, thumb ring rotation, and thumb/finger ring diameter, so as to enable effective control, in conjunction with unstrained wrist movements, of scissor roll, yaw and pitch. A set of interchangeable thumb rings of various inner diameters accommodate a range of anatomical thumb sizes. Each of the interchangeable thumb rings is rotatably attachable to the lower shank through multiple discrete placement openings in the bottom face of the lower shank.

4 Claims, 2 Drawing Sheets

ERGONOMIC SCISSORS

BACKGROUND OF THE INVENTION

The present invention relates to the field of cutting devices, and more particularly to the field of hand-operated scissors and shears, and specifically to the field of scissors and shears having an ergonomic design in which one or more components of the device are adjustable so as to better conform to the configuration of the operator's hand and the desired cutting orientation of the device. In the following text, the term "scissors" will be used to denote both scissors and shears.

Scissors are a device comprising two blades that are connected together such that, when an operator applies manual pressure, the blades slide past each other, producing a shearing action that cuts a material inserted between the blades. The earliest scissors, dating back over 3000 years to ancient Egypt, were of the "spring" design, having two blades connected at the handle by an arcuate strip of metal that keeps the blades apart until manual pressure is applied. The current "cross-bladed" design originated with the Romans about 100 AD. In this form, scissors comprise two blades conjoined at a pivot, with each blade connected via a shank to a ring or loop that accommodates one or more fingers. Mechanically, such scissors constitute a first-class double-lever system, with the pivot acting as the common fulcrum.

Scissors can be configured as either right-handed or left-handed, with one configuration being the mirror-image of the other. When the blades are fully separated, the scissors are said to be in an open position, as opposed to the closed position, in which the blades fully engage each other along their entire length.

For the purpose of establishing terminology and spatial orientation, FIG. 1*a* illustrates an exemplary pair of right-handed cross-bladed scissors in a perspective view of the closed position. In this illustration, the blades are aligned with the vertical plane. The exemplary scissors comprise a first blade, a second blade, an upper shank, a lower shank, a finger ring, a thumb ring, a pivot, a tang and a thumb stop. The proximal end of the first blade transitions into the upper shank, which in turn transitions into the finger ring, which in turn transitions into the tang. The proximal end of the second blade transitions into the lower shank, which in turn transitions into the thumb ring, which in turn transitions into the thumb stop. The two blades are pivotally connected near their proximal ends by the pivot, which is typically a screw or pin. In the closed position, the thumb stop engages the finger ring or the upper shank, thereby preventing the blades from crossing beyond the fully overlapped position so as to avoid excessive blade wear and/or deformation.

In the exemplary right-handed configuration of FIG. 1*a*, the index and middle fingers of the operator's right hand rest on the upper shank; the ring finger is inserted into the finger ring; the pinkie finger rests on the tang; and the thumb is inserted into the thumb ring. When the operator's hand is opened, the leverage of the increased separation between the ring finger and thumb causes the first and second blades to diverge in a V-form from the pivot, thus putting the scissors in an open position. When the operator's hand is closed, the leverage of the diminished separation between the ring finger and thumb causes the first and second blades to converge in an I-form at the pivot, thus putting the scissors in a closed position.

FIG. 1*b* depicts the same exemplary scissors as FIG. 1*a*, again in a perspective view of the closed position, showing the three axes about which the scissors can rotate. The longitudinal axis extends forward along the line that connects the pivot to the distal tip of the blades. The vertical axis extends upward from the pivot perpendicular to the longitudinal axis in the vertical plane. The horizontal axis extends laterally leftward from the pivot perpendicular to the longitudinal axis in the horizontal plane. For a right-handed pair of scissors, as illustrated in FIG. 1*b*, the vertical axis is oriented clockwise with respect to the longitudinal axis, while the horizontal axis is oriented counterclockwise with respect to the longitudinal axis. For a left-handed pair of scissors (not shown) the vertical axis would be oriented counterclockwise with respect to the longitudinal axis, while the horizontal axis would be oriented clockwise with respect to the longitudinal axis.

Referring to FIG. 1*b*, the scissors can rotate in three different planes: about the longitudinal, vertical or horizontal axes. Borrowing the terminology of aeronautics, we can refer to these three types of rotation as "roll", "yaw" and "pitch", respectively. Ergonomically efficient scissors, therefore, must be designed so that the anatomy of the human hand and wrist is compatible with controlling the roll, yaw and pitch of the scissors without engendering undue physical strain and/or fatigue. One of the problems in creating such an ergonomic design is the wide variability of human anatomy in terms of the size of individual hands and wrists and the length and spacing of the fingers. Consequently, a pair of scissors that's designed for the average person will prove awkward and even painful to use for many people, with long-term effects such as carpal tunnel syndrome.

Aside from anatomical variability, the uses to which scissors are put will also influence the optimum ergonomic design. In cutting cloth, for example, the scissors are usually held vertically, with the tip pointing away from the operator. In cutting human hair, on the other hand, the scissors may be held vertically, for trimming the temples, or horizontally, for trimming the top of the head, with the tip generally pointing to the left for a right-handed operator. Pet groomers, however, will also need to hold the scissors vertically, with the tip pointing up or down, in order to trim the flanks and legs of the animal. Since the orientation of the hand on the scissors will be different in each of these applications, no single non-adjustable design will be ergonomically optimal for all of them.

The prior art includes a number of designs that are adjustable with respect to one or more parameters. These parameters include:

- Thumb offset: the location of the thumb ring with respect to the finger ring;
- Thumb/finger ring rotation: to control roll, yaw and pitch; and
- Thumb/finger ring size adjustment.

Several patents provide for a thumb ring that slides along the lower shank of the scissors. The earliest of these dates back to 1923 in the patent of Gosha, U.S. Pat. No. 1,479,908. Later examples are the patents of Dolph, U.S. Pat. No, 2,158,277, Chuba, U.S. Pat. No. 2,744,324, and Pinto, U.S. Pat. No. 4,146,961. None of these provide for size-adjustable thumb or finger rings. Consequently, these designs cannot provide a universally snug fit for the operator's thumb and ring finger, which will diminish efficiency and comfort of use. Nor do these designs provide any means for rotating the thumb and/or finger rings to achieve optimal control over the roll, yaw and pitch of the scissors. Without such rotation features, all rotational movement must be achieved purely by wrist movements. While the anatomy of the wrist comfortably lends itself to rolling rotation, through a range of about 180°, the same is not true of yaw and pitch, which demand awkward twisting of the wrist through a very constrained range of motion.

Pivoting thumb rings of various types are disclosed in the prior art going as far back as 1897, in the Nolen patent, U.S. Pat. No. 590,330. Later examples of pivoting thumb ring designs are the Pracht patent, U.S. Pat. No. 5,109,608 and the Brenton application, US 2005/0204569. But, since none of these provide a means for locking the thumb ring into a fixed pivoted orientation, rotational control of the scissors is unacceptably unstable. In each of these designs, the thumb ring rotates about the vertical axis only, so that there is no means of controlling pitch short of twisting the wrist. These designs also lack a means for adjusting the thumb offset by relocating the thumb ring along the lower shaft of the scissors. They also fail to provide adjustable sizes for either thumb or finger rings.

Pivoting, interchangeable thumb rings of various sizes are taught by the patent of Brenton et al., U.S. Pat. No. 5,469,624. No means for locking the thumb ring into a fixed pivoted orientation is disclosed, however, nor is there a means for relocating the thumb ring along the lower shaft of the scissors. Moreover, the thumb ring rotates about the vertical axis only, so that there is no means of controlling the pitch of the scissors without twisting the wrist.

The patent of Gauvrey, U.S. Pat. No. 4,642,895, discloses a thumb ring mounted on a sleeve that slides along the lower shaft of the scissors. The thumb ring rotates about the vertical axis only, so that there is no means of controlling scissor pitch without twisting the wrist. Since thumb ring rotation is enabled by a bulky ball-and-socket assembly, the thumb ring is displaced too far from the finger ring to provide an ergonomically efficient configuration. The Gauvrey patent also lacks a means of adjusting the diameter of the thumb or finger rings to accommodate anatomical variations.

The patent application of Lauritzen et al., Pub. No. US 2006/0064879, teaches a thumb ring that's integrated with a sleeve which slides along a shortened lower shaft and also rotates around the lower shaft. A ball-and-socket joint connecting the finger ring to a curved upper shaft enables rotation of the finger ring. This design has several disadvantages. The sizes of the thumb ring and finger ring openings are not adjustable. The basic structure of the scissors is radically altered by specifying a short lower shank and a curved upper shank, thereby requiring special fabrication and increased manufacturing expense.

Since the rotation of the thumb ring in the Lauritzen design is about the longitudinal axis only, only roll can be controlled. This is not optimal, since the natural movement of the wrist can effectively control roll through a wide range of about 180°. While the rotatable connector between the upper shank and finger ring provides limited control of pitch and yaw, it does so at the cost of laterally and vertically displacing the finger ring outside the plane of the lower shaft and thumb ring. The lateral displacement of the finger ring adversely affects blade movement by introducing lateral components into the manual force applied to the finger ring. Such lateral force components will tend to compress the blades together, thereby increasing blade wear and deformation over time. The vertical displacement of the finger ring prevents engagement of the finger ring with the lower shaft and/or thumb stop in the closed position, thereby allowing the blades to cross over each other beyond the fully overlapped position, which again will increase long-term blade wear and deformation.

Consequently, there remains a need, as yet unmet by the prior art, for ergonomic scissors that are adjustable with respect to thumb offset, thumb ring rotation, and thumb/finger ring diameter, so as to enable effective control, in conjunction with unstrained wrist movements, of scissor roll, yaw and pitch. As will now be described, the present invention provides a practical, easy-to-use, economical design that incorporates these essential ergonomic adjustments.

SUMMARY OF THE INVENTION

The ergonomic scissor design of the present invention is similar to the basic scissors configuration depicted in FIGS. 1*a* and 1*b*, except that, instead of a fixed thumb ring that transitions out of the lower shank, there are a set of interchangeable thumb rings of various inner diameters, thereby accommodating a range of anatomical thumb sizes. Each of the interchangeable thumb rings is rotatably attachable to the lower shank through multiple placement openings in the bottom and/or lateral face of the lower shank. Each thumb ring has a base with a ring aperture through which is inserted an attachment means, such as a shoulder screw. The attachment means cooperates with the placement openings in the lower shank, such that the thumb ring can be securely tightened into any one of the openings along the lower shank. This allows the offset between the thumb and finger ring to be adjusted to accommodate both anatomical variations and various hand orientations required for different scissor uses.

Optionally, the sizes of the thumb rings can be further adjusted using interchangeable ring inserts having various inner diameters to accommodate anatomical variation in thumbs. The thumb inserts are annular in shape, with an outer diameter slightly greater than the inner diameter of the thumb ring. The outer diameter of the insert has a channel groove, the bottom of which matches the inner diameter of the thumb ring, such that the insert can be securely snapped into place within the thumb ring.

When the thumb ring has been tightly secured to one of the placement openings in the lower shank, it remains free to rotate through 360° about the axis of the attachment means. Once the thumb ring has been rotated to the desired angle, it is tightly secured at that angle by a fixing means in the base of the thumb ring, such as a set screw that engages the attachment means. Thus, if the thumb ring is secured to one of the placement openings in the bottom face of the lower shank, the ring can be rotated 360° about the vertical axis of the scissors, thereby providing complete control of yaw. If instead the thumb ring is secured to one of the placement openings in the lateral face of the lower shank (right lateral for right-handed scissors and left lateral for left-handed scissors), the ring can be rotated 360° about the horizontal axis of the scissors, thereby providing complete control of pitch.

The finger ring of the present invention is integral with the upper shank, as it is in conventional scissors. But the size of the finger ring can be adjusted using interchangeable finger ring inserts having various inner diameters to accommodate anatomical variation in ring fingers. The finger ring inserts are annular in shape, with an outer diameter slightly greater than the inner diameter of the finger ring. The outer diameter of the insert has a channel groove, the bottom of which matches the inner diameter of the finger ring, such that the insert can be securely snapped into place within the finger ring.

The foregoing features of the present invention provide an ergonomic scissor design which accommodates a broad range of anatomical variations and can be applied to a wide variety of end uses. Adjustments can be made to thumb ring position and rotation so as to provide secure handling of the scissors at virtually any angle of roll, pitch and yaw without the strain of twisting the wrist. Interchangeable thumb rings and finger ring inserts allow the scissors to be shared by multiple operators while providing a secure thumb/finger fit for each.

Other features, objects and advantages of the present invention will become apparent from the following descriptions, taken in connection with the accompanying drawings, in which, by way of illustration and example, a preferred embodiment of the present invention is disclosed.

DETAILED DESCRIPTION OF THE PREFERRED EMBODIMENT

Figure 1A:
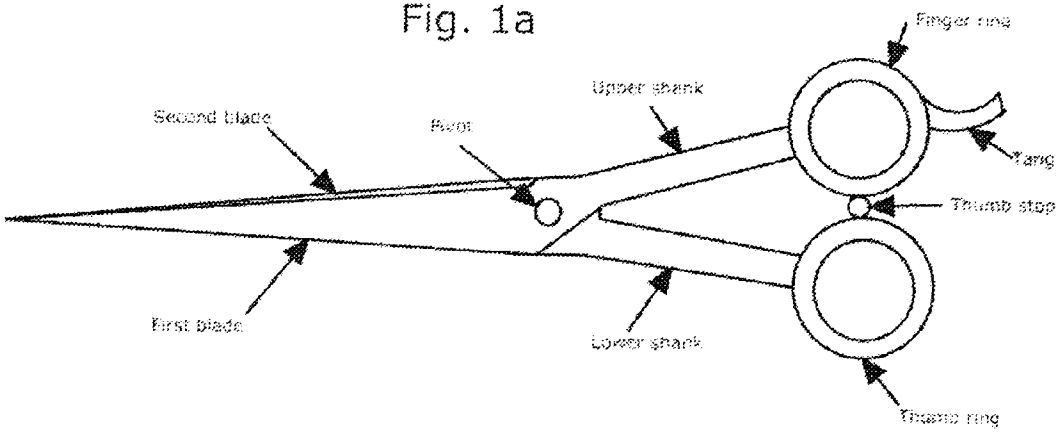
FIG. 1*a* is a perspective view of a conventional pair of right-handed cross-bladed scissors in the closed position.
Figure 1B:
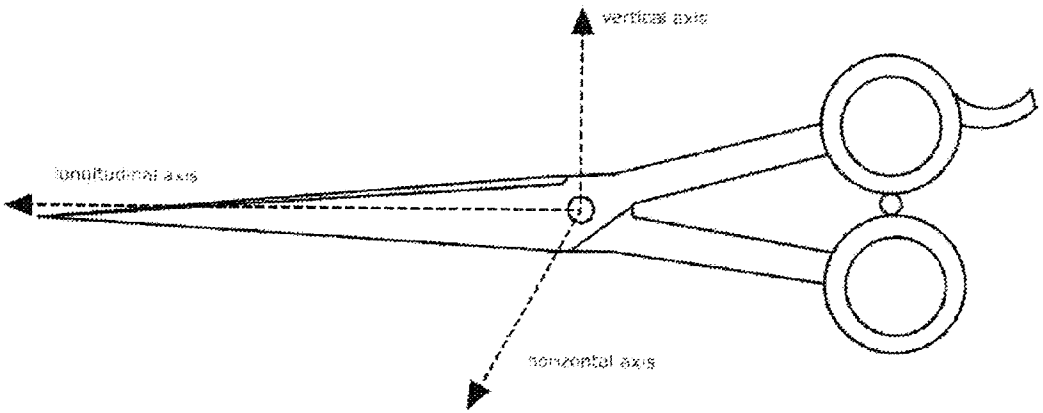
FIG. 1*b* depicts the conventional scissors of FIG. 1*a* showing the three axes of rotation.
Figure 2A:
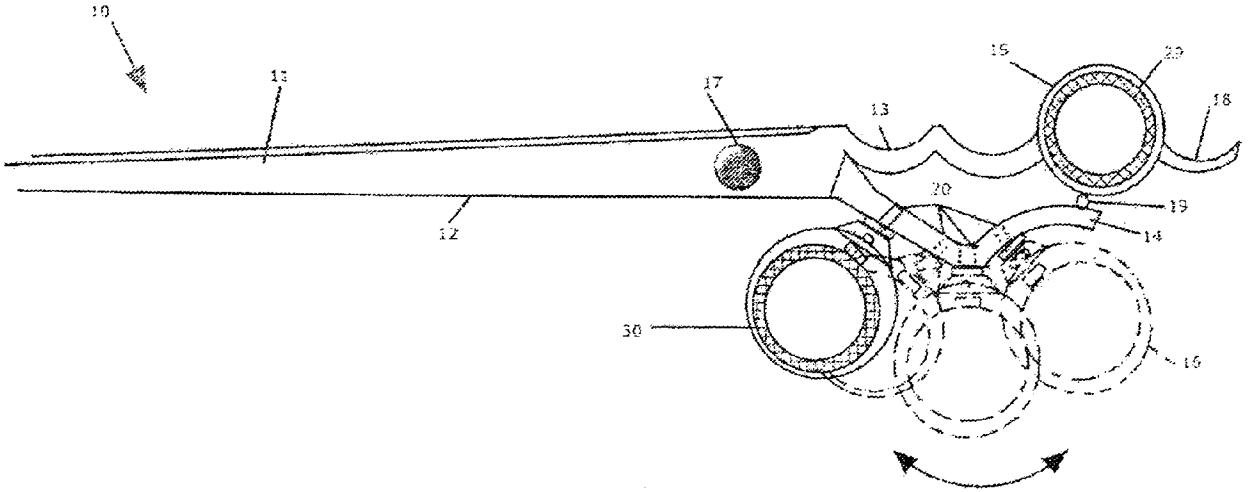
FIG. 2*a* is a plan view of the ergonomic scissors in accordance with the preferred embodiment of the present invention, in which an interchangeable thumb ring is depicted at various positions along the lower shank.

Referring to FIG. 2*a*, the preferred embodiment of the present invention 10 comprises a first blade 11, a second blade 12, an upper shank 13, a lower shank 14, a finger ring 15, multiple interchangeable thumb rings 16, a pivot 17, a tang 18, and a stop 19. The proximal end of the first blade 11 transitions into the upper shank 13, which in turn transitions into the finger ring 15, which in turn transitions into the tang 18. The proximal end of the second blade 12 transitions into the lower shank 14, which in turn transitions into the stop 19. The two blades are pivotally connected near their proximal ends by the pivot 17, which is typically a screw or pin. In the closed position, as depicted in FIG. 2*a*, the stop 19 engages the finger ring 15, thereby preventing the blades from crossing beyond the fully overlapped position so as to avoid excessive blade wear and/or deformation.

The multiple interchangeable thumb rings 16 have various inner diameters, thereby accommodating a range of anatomical thumb sizes. Optionally, the sizes of the thumb rings 16 can be further adjusted using interchangeable ring inserts 30 having various inner diameters to accommodate anatomical variation in thumbs. The thumb inserts 30 are annular in shape, with an outer diameter slightly greater than the inner diameter of the thumb ring 16. The outer diameter of the insert 30 has a channel groove, the bottom of which matches the inner diameter of the thumb ring 16, such that the insert can be securely snapped into place within the thumb ring 16.

Figure 2C:
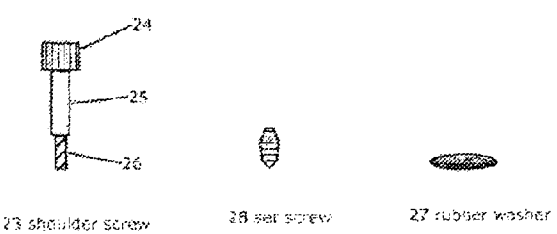
FIG. 2*c* depicts detail views of the shoulder screw, set screw and washer.
Figure 2B:
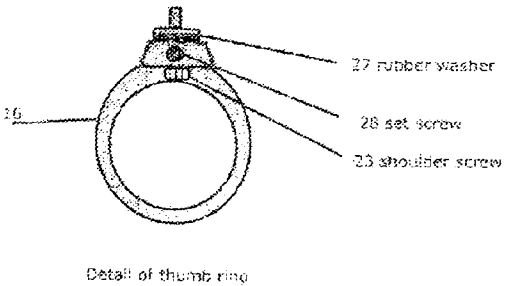
FIG. 2*b* is a detail view of one of the interchangeable thumb rings, depicting its components.

Each of the interchangeable thumb rings 16 is rotatably attachable to the lower shank 14 through multiple placement openings 20 in the bottom and/or lateral face of the lower shank 14. As shown in the detail view of FIG. 2*b*, each thumb ring 16 has a base 21 with a ring aperture 22 through which is inserted a shoulder screw 23. As depicted in the detail of FIG. 2*c*, the shoulder screw 23 comprises a head 24, a shoulder 25, and a thread 26. Each of the placement openings 20 is internally threaded with threading that accommodates the thread 26 of the shoulder screw 23. The head 24 of the shoulder screw 23 can be turned to thread the screw 23 into any one of the placement openings 20, thereby securing the thumb ring 16 tightly into the bottom or lateral face of the lower shank 14. In order to better secure the thumb ring 16 to the lower shank 14, a rubber washer 27 is inserted over the thread 26 of the shoulder screw 23 between the base 21 of the thumb ring 16 and the placement opening 20. Thus, the offset between the thumb ring 16 and finger ring 15 can be adjusted to accommodate both anatomical variations and various hand orientations required for different scissor uses.

When one of the interchangeable thumb rings 16 has been tightly secured to one of the placement openings 20 in the lower shank 14, it remains free to rotate through 360° about the shoulder 25 of the shoulder screw 23. Once the thumb ring 16 has been rotated to the desired angle, it is tightly secured at that angle by tightening a set screw 28 inserted perpendicularly into the base of the thumb ring 16. When tightened, the set screw 28 engages the shoulder 25 of the shoulder screw 23, thereby preventing further rotation.

If the thumb ring 16 is secured to one of the placement openings 20 in bottom face of the lower shank 14, the thumb ring 16 can be rotated 360° about the vertical axis of the scissors, thereby providing complete control of yaw. If instead the thumb ring 16 is secured to one of the placement openings 20 in the lateral face of the lower shank 14 (right lateral for right-handed scissors and left lateral for left-handed scissors), the thumb ring 16 can be rotated 360° about the horizontal axis of the scissors, thereby providing complete control of pitch.

Although the finger ring 15 of the present invention 10 is integral with the upper shank 13, the size of the opening of the finger ring 15 can be adjusted using interchangeable finger ring inserts 29 having various inner diameters to accommodate anatomical variation in ring finger sizes. The finger ring inserts 29 are annular in shape, with an outer diameter slightly greater than the inner diameter of the finger ring 15. The outer diameter of the insert 29 has a channel groove, the bottom of which matches the inner diameter of the finger ring 15, such that the insert 29 can be securely snapped into place within the finger ring 15.

Although a preferred embodiment of the invention has been disclosed for illustrative purposes, those skilled in the art will appreciate that many additions, modifications and substitutions are possible, without departing from the scope and spirit of the present invention as defined by the accompanying claims.

What is claimed is:

1. Ergonomic scissors, comprising:

(a) a first blade, a second blade, an upper shank, a lower shank, and a finger ring, wherein the proximal end of the first blade integrally connects with the distal end of the upper shank, and the proximal end of the upper shank integrally connects with the finger ring, and the proximal end of the second blade integrally connects with the distal end of the lower shank, and wherein the lower shank has a top face and a bottom face;

(b) a pivot that pivotally connects the proximal ends of the first blade and the second blade and acts as a fulcrum between the first blade and the second blade, such that the blades angularly diverge in an open position and overlappingly engage one another in a closed position;

(c) a longitudinal axis that, in the closed position, extends from the pivot to the overlapped distal ends of the first blade and the second blade;

(d) a plurality of distinct and separate placement openings in the bottom face of the lower shank; and (e) a plurality of interchangeable thumb rings, each having a different internal diameter, each of which thumb rings has an attachment assembly by which the thumb ring is rotatably attachable to any one of the placement openings, wherein the attachment assembly comprises a shoulder screw having a longitudinal axis about which the thumb ring can rotate and a set screw that has a longitudinal axis that is oriented perpendicularly to the longitudinal axis of the shoulder screw, such that the set screw, when tightened, perpendicularly engages the shoulder screw so that further rotation of the thumb ring is prevented.

2. The ergonomic scissors according to claim 1, further comprising a plurality of annular inserts, each having a different inner diameter and each tightly insertable into the finger ring.

3. The ergonomic scissors according to claim 2, wherein the proximal side of the finger ring integrally connects to a curved tang appendage.

4. The ergonomic scissors according to claim 3, wherein the top face of the lower shank integrally connects to a short, blunt stop appendage, such that the stop appendage engages the finger ring in the closed position.

* * * * *